US010619919B2

(12) United States Patent
Gahier et al.

(10) Patent No.: US 10,619,919 B2
(45) Date of Patent: Apr. 14, 2020

(54) METHOD FOR PRODUCING A METHANE-RICH STREAM AND A $C_2^+$ HYDROCARBON-RICH STREAM, AND ASSOCIATED EQUIPMENT

(75) Inventors: Vanessa Gahier, Jouy le Moutier (FR); Julie Gouriou, Rueil Malmaison (FR); Sandra Thiebault, Coye-la-Foret (FR); Loic Barthe, Paris (FR)

(73) Assignee: TECHNIP FRANCE, Courbevoie (FR)

( * ) Notice: Subject to any disclaimer, the term of this patent is extended or adjusted under 35 U.S.C. 154(b) by 1016 days.

(21) Appl. No.: 13/976,307

(22) PCT Filed: Dec. 26, 2011

(86) PCT No.: PCT/EP2011/074051
§ 371 (c)(1),
(2), (4) Date: Sep. 5, 2013

(87) PCT Pub. No.: WO2012/089709
PCT Pub. Date: Jul. 5, 2012

(65) Prior Publication Data

US 2014/0290307 A1 Oct. 2, 2014

(30) Foreign Application Priority Data

Dec. 27, 2010 (FR) ..... 10 61273

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01);
(Continued)

(58) Field of Classification Search
CPC ..... F25J 3/0209; F25J 3/0238; F25J 3/0233; F25J 2210/06; F25J 2240/02
(Continued)

(56) References Cited

U.S. PATENT DOCUMENTS 5,881,569 A * 3/1999 Campbell ..... F25J 3/0209 62/621
5,983,664 A * 11/1999 Campbell ..... F25J 3/0209 62/621
(Continued)

FOREIGN PATENT DOCUMENTS

FR 2817767 6/2002
WO WO 2011/004123 A2 1/2011
(Continued)

OTHER PUBLICATIONS

PCT International Search Report dated Oct. 24, 2012 (Form PCT/ISA/220) and PCT Opinion (Form PCT/ISA/237) (in French) corresponding to International Application No. PCT/EP2011/074051 filed Dec. 26, 2011 (in French).
(Continued)

*Primary Examiner* — John F. Pettitt, III
(74) *Attorney, Agent, or Firm* — Locke Lord LLP; Alan B. Clement; Peter J. Fallon

(57) ABSTRACT

This method comprises a separation of a feed stream (16) into a first fraction (41A) and a second fraction (41B). It comprises injecting the first cooled feed fraction (42) into a first separating flask (22) to produce a light head stream (44). The method comprises expanding a turbine feed fraction (48) resulting from the light head stream (44) in a first turbine (26) up to a first pressure and injecting the first expanded fraction (54) into a distillation column (30).
The method comprises expanding the second fraction of the feed stream (41B) in a second turbine (40) up to a second pressure substantially equal to the first pressure.
The second expanded fraction (91A) from the second dynamic expansion turbine (40) is used to form a cooled reflux stream (91B) injected into the column (30).

7 Claims, 6 Drawing Sheets

(52) U.S. Cl.
CPC ..... *F25J 2200/02* (2013.01); *F25J 2200/38* (2013.01); *F25J 2200/70* (2013.01); *F25J 2200/76* (2013.01); *F25J 2205/04* (2013.01); *F25J 2210/06* (2013.01); *F25J 2230/24* (2013.01); *F25J 2230/32* (2013.01); *F25J 2230/60* (2013.01); *F25J 2240/02* (2013.01); *F25J 2290/80* (2013.01)

(58) Field of Classification Search
USPC ..... 62/630
See application file for complete search history.

(56) References Cited

U.S. PATENT DOCUMENTS

| | | | | |
|---|---|---|---|---|
| 6,271,433 | B1 | 8/2001 | Keady et al. | |
| 6,526,777 | B1 | 3/2003 | Campbell et al. | |
| 2002/0007101 | A1 | 1/2002 | Senetar et al. | |
| 2004/0177646 | A1 | 9/2004 | Wilkinson et al. | |
| 2006/0004242 | A1 | 1/2006 | Verma et al. | |
| 2007/0199865 | A1 | 8/2007 | Pham Duc | |
| 2008/0081938 | A1 | 4/2008 | Schultz et al. | |
| 2009/0194461 | A1* | 8/2009 | Bras | C10L 3/10 208/368 |
| 2009/0282865 | A1 | 11/2009 | Martinez et al. | |
| 2010/0043488 | A1* | 2/2010 | Mak | F25J 3/0209 62/620 |
| 2010/0263407 | A1 | 10/2010 | Paradowski et al. | |
| 2010/0300144 | A1* | 12/2010 | Madison | F16K 11/074 62/613 |
| 2011/0005273 | A1 | 1/2011 | Gahier et al. | |
| 2012/0172649 | A1 | 7/2012 | Yadav et al. | |
| 2013/0119666 | A1* | 5/2013 | Holt | F03B 13/00 290/52 |

FOREIGN PATENT DOCUMENTS

| | | |
|---|---|---|
| WO | WO 2011/051614 A2 | 5/2011 |
| WO | WO 2011/056712 A2 | 5/2011 |
| WO | WO 2012/089709 A2 | 7/2012 |

OTHER PUBLICATIONS

Joet T. Lynch et al., "Texas plant retrofit improves throughput, $C_2$ recovery," Oil & Gas Journal (Jun. 3, 1996), pp. 41-48.
EP Search Report dated Jul. 20, 2015—EP Application No. 14307211.4-1361.
PCT Notification of Transmittal of the International Search Report and the Written Opinion of the International Searching Authority, or the Declaration dated Apr. 8, 2016 for International Application No. PCT/EP2015/081371 filed Dec. 29, 2015.
Search Report dated Mar. 12, 2014 corresponding to French Application No. 1356061.
Search Report dated Jun. 12, 2014 (in French).

* cited by examiner

METHOD FOR PRODUCING A METHANE-RICH STREAM AND A $C_2^+$ HYDROCARBON-RICH STREAM, AND ASSOCIATED EQUIPMENT

This application is a National Stage patent application of International Patent Application Number, PCT/EP2011/074051, filed on Dec. 26, 2011, which claims priority to FR 10 61273, filed on Dec. 27, 2010.

The present invention relates to a method for producing a methane-rich stream and a $C_2^+$ hydrocarbon-rich stream from a feed stream containing hydrocarbons, of the type comprising the following steps:

- separating the feed stream into a first fraction of the feed stream and at least one second fraction of the feed stream;
- cooling the first fraction of the feed stream in a first heat exchanger;
- injecting the first fraction of the cooled feed stream in a first separating flask to produce a light head stream and a heavy bottoms stream;
- expanding a turbine feed fraction formed from the light head stream in a first dynamic expansion turbine up to a first pressure and injecting at least part of the first expanded fraction coming from the first turbine into a first distillation column;
- expanding at least part of the heavy bottoms stream to form an expanded bottoms stream and injecting the expanded bottoms stream into the first distillation column without going through the first heat exchanger between the first separating flask and the first distillation column;
- recovering a bottoms stream at the bottom of the first distillation column, the $C_2^+$ hydrocarbon-rich stream being formed from the column stream;
- recovering and heating a methane-rich overhead stream;
- compressing at least one fraction of the overhead stream in at least a first compressor coupled to the first dynamic expansion turbine and in at least one second compressor;
- forming a methane-rich stream from the heated and compressed overhead stream.

Such a method is intended to extract $C_2^+$ hydrocarbons, such as in particular ethylene, ethane, propylene, propane and heavier hydrocarbons, in particular from natural gas, refinery gas or synthetic gas obtained from other hydrocarbonaceous sources such as coal, raw oil, or naphtha.

Natural gas generally contains a majority of methane and ethane making up at least 50% by moles of the gas. It also contains a more negligible quantity of heavier hydrocarbons, such as propane, butane, pentane. In certain cases, it also contains helium, hydrogen, nitrogen and carbon dioxide.

It is necessary to separate the heavier hydrocarbons from the natural gas to respond to at least two imperatives.

First, economically, $C_2^+$ hydrocarbons, and especially ethane, propane and butane, can be exploited. Furthermore, the demand for natural gas liquids as feeds for the petrochemical industry is continuously increasing and should continue to increase in the coming years.

Furthermore, for method reasons, it is desirable to separate the heavy hydrocarbons so as to prevent them from condensing during transport and/or manipulation of the gases. This makes it possible to avoid incidents such as the arrival of liquid plugs in transport or treatment equipment designed for gas effluents.

To separate the $C_2^+$ hydrocarbons from the natural gas, it is known to use an oil absorption method that makes it possible to recover up to 90% of the propane and up to about 40% of the ethane.

To achieve higher recovery rates, cryogenic expansion methods are used.

In one known cryogenic expansion method, part of the feed stream containing the hydrocarbons is used for the secondary reboilers of a splitter of the methane.

Then, the different effluents, after partial condensation, are combined to feed a gas-liquid separator.

As described in U.S. Pat. No. 5,555,748, the light stream obtained at the head of the separator is divided into a first column feed fraction, which is condensed before being sent toward the head feed of the distillation column and a second fraction that is sent toward a dynamic expansion turbine before being injected into the distillation column.

This method has the advantage of being easy to start and offering significant working flexibility, combined with good effectiveness and good safety.

However, economic constraints require further increasing the effectiveness of the method while preserving a very high methane extraction output. It is also necessary to minimize the bulk of the equipment and to reduce, or even eliminate the contribution of outside refrigerants such as propane, in particular to implement the method on floating equipment or in safety-sensitive areas.

One aim of the invention is therefore to obtain a production method that makes it possible to separate a feed stream containing hydrocarbons into a $C_2^+$ hydrocarbon-rich stream and a methane-rich stream, very economically, with a small bulk, and very effectively.

To that end, the invention relates to a method of the aforementioned type, characterized in that the method comprises the following steps:

- expanding at least part of the second fraction of the feed stream in a second dynamic expansion turbine, separate from the first dynamic expansion turbine, up to a second pressure, to form a second expanded fraction coming from the second dynamic expansion turbine, the second pressure being substantially equal to the first pressure; and
- cooling and at least partially liquefying at least part of the second expanded fraction coming from the second dynamic expansion turbine to form a cooled reflux stream in the first distillation column.

The method according to the invention can comprise one or more of the following features, considered alone or according to all technically possible combinations:

- the pressure difference between the first pressure and the second pressure is less than 8 bars;
- the temperature of the part of the second fraction of the feed stream injected into the second dynamic expansion turbine is higher than the temperature of the turbine feed fraction injected into the first dynamic expansion turbine;
- the method includes the injection of the first expanded fraction from the first dynamic expansion turbine into a second heat exchanger to be cooled and partially liquefied therein, the first cooled expanded fraction forming an additional cooled reflux stream, the method including the injection of the additional cooled reflux stream into the first distillation column;
- the method comprises the following steps:
  - injecting the second expanded fraction coming from the second dynamic expansion turbine into a downstream separating flask to form a second gas head stream and a second liquid bottoms stream, cooling the second gas head stream to form a cooled reflux stream, injecting at least part of the second expanded fraction from the second dynamic expansion turbine into an auxiliary column, and forming a cooled reflux stream from the bottoms stream of the auxiliary column;

possibly, partially condensing the second fraction of the feed stream;

injecting the second fraction of the feed stream into an upstream separating flask to form a second gas fraction and a second liquid fraction;

injecting the second gas fraction into the second dynamic expansion turbine;

injecting the second liquid fraction, after expansion, into a lower part of the first distillation column;

the entire second fraction of the feed stream is injected into the second dynamic expansion turbine, possibly without cooling between the step for separating the feed stream and the step for injecting the second fraction of the feed stream into the second dynamic expansion turbine;

the method includes the following steps:

removing a secondary compression fraction in the methane-rich overhead stream, before the passage of a fraction of the methane-rich overhead stream in the first compressor, passage of the secondary fraction in a third compressor coupled to the second dynamic expansion turbine;

injecting the compressed secondary fraction from the third compressor into the fraction of the compressed overhead stream, downstream of the first compressor;

the second compressor comprises a first compression stage, at least one second compression stage, and a refrigerant inserted between the first compression stage and the second compression stage, the method including a step for passage of the compressed overhead stream from the first compressor successively in the first compression stage, the refrigerant, then the second compression stage;

at least part of the second expanded fraction from the second dynamic expansion turbine, at least one fraction of the overhead stream, and possibly the first expanded fraction from the first dynamic expansion turbine, are placed in a heat exchange relationship;

the method comprises the following steps:

dividing the light head stream into the turbine feed fraction and a column feed fraction;

cooling and at least partially condensing the column feed stream in a second heat exchanger, expanding and at least partially injecting the cooled column feed fraction into the first distillation column, at least part of the second expanded fraction from the second dynamic expansion turbine and the column feed fraction advantageously being placed in a heat exchange relationship;

at least a fraction of the overhead stream and at least one part of the second expanded fraction from the second dynamic expansion turbine are placed in a heat exchange relationship in a downstream heat exchanger separate from the second heat exchanger;

the method comprises the following steps:

removing a bleed stream from the overhead stream;

cooling the bleed stream at least in the first heat exchanger and injecting the cooled bleed stream into the first distillation column; and possibly, heat exchange of the bleed stream with at least part of the second expanded fraction from the second turbine.

the method includes the following steps:

removing a reboiling stream in the first distillation column at a removal level;

putting the reboiling stream in a heat exchange relationship with at least part of the second expanded fraction coming from the second dynamic expansion turbine to cool and at least partially liquefy the part of the expanded second fraction coming from the second dynamic expansion turbine; and possibly, placement in a heat exchange relationship with the first expanded fraction from the first turbine;

reinjecting the reboiling stream into the first distillation column at a level below the removal level.

the method includes the following steps:

removing an extra cooling stream from the methane-rich overhead stream or from the stream formed from the methane-rich overhead stream;

expanding and injecting the expanded extra cooling stream into a stream circulating upstream of the first expansion turbine, advantageously in the first fraction of the cooled feed stream or in the turbine feed fraction;

the method comprises the following steps:

passage of the methane-rich overhead stream in the first heat exchanger;

removal of an auxiliary expansion stream in the methane-rich overhead stream, after its passage in the first heat exchanger;

dynamic expansion of the auxiliary expansion stream in an auxiliary dynamic expansion turbine; and injecting the expanded stream from the auxiliary dynamic expansion turbine into the methane-rich overhead stream, before its passage in the first heat exchanger.

The invention also relates to equipment for producing a methane-rich stream and a $C_2^+$ hydrocarbon-rich stream from a feed stream containing hydrocarbons, of the type comprising:

means for separating the feed stream into a first fraction of the feed stream and at least one second fraction of the feed stream;

a first heat exchanger to cool the first fraction of the feed stream;

means for injecting the first cooled feed fraction into a first separating flask to produce a light head stream and a heavy bottoms stream;

a first dynamic expansion turbine and means for injecting a turbine feed fraction formed from the light head stream into the first dynamic expansion turbine so as to expand the turbine feed fraction up to a first pressure;

a first distillation column;

means for injecting at least part of the first expanded fraction into the first turbine in the first distillation column;

means for expanding at least part of the heavy bottoms stream to form an expanded bottoms stream and means for injecting at least part of the expanded bottoms stream into the first distillation column, the means for injecting the expanded bottoms stream being configured so that the bottoms stream does not pass through the first heat exchanger between the first separating flask and the first distillation column;

means for recovering a bottoms stream at the bottom of the first distillation column, the $C_2^+$ hydrocarbon-rich stream being formed from the bottoms stream;

means for recovering and heating a methane-rich overhead stream, at least one first compressor coupled to the first dynamic expansion turbine and at least one second compressor to compress at least one fraction of the overhead stream;

means for forming a methane-rich stream from the heated and compressed overhead stream from the second compressor;

characterized in that the equipment comprises:

a second dynamic expansion turbine, separate from the first dynamic expansion turbine, means for injecting at least part of the second fraction of the feed stream into the second dynamic expansion turbine to form a second expanded fraction from the second dynamic expansion turbine at a second pressure, the second dynamic expansion turbine being arranged so that the first pressure is substantially equal to the second pressure; and means for cooling and at least partially liquefying at least part of the second fraction from the second dynamic expansion turbine to form a cooled reflux stream and means for injecting the cooled reflux stream into the first distillation column.

The equipment according to the invention can comprise the following feature:

the equipment comprises:

an auxiliary column;

means for injecting at least part of the second expanded fraction from the second dynamic expansion turbine into the auxiliary column; and means for forming the cooled reflux stream from the bottoms stream of the auxiliary column.

The invention will be better understood upon reading the following description, provided solely as an example, and done in reference to the appended drawings, in which.

In all of the following, the same references will be used to designate a stream circulating in a pipe and the pipe transporting it.

Furthermore, unless otherwise indicated, the cited percentages are molar percentages and the pressures are given in absolute bars.

In the digitally simulated examples, the output of each compressor is chosen to be 82% polytropic and the output of each turbine is 85% adiabatic.

Likewise, the distillation columns described use plates, but they can also use bulk or structured trim. A combination of plates and trim is also possible. The additional turbines described drive compressors, but they can also drive variable-frequency electric generators whereof the electricity produced can be used in the network via a frequency converter. The streams whereof the temperature is higher than the ambient temperature are described as being cooled by aero-refrigerants. Alternatively, it is possible to use water exchangers, for example using fresh water or seawater.

Figure 1:
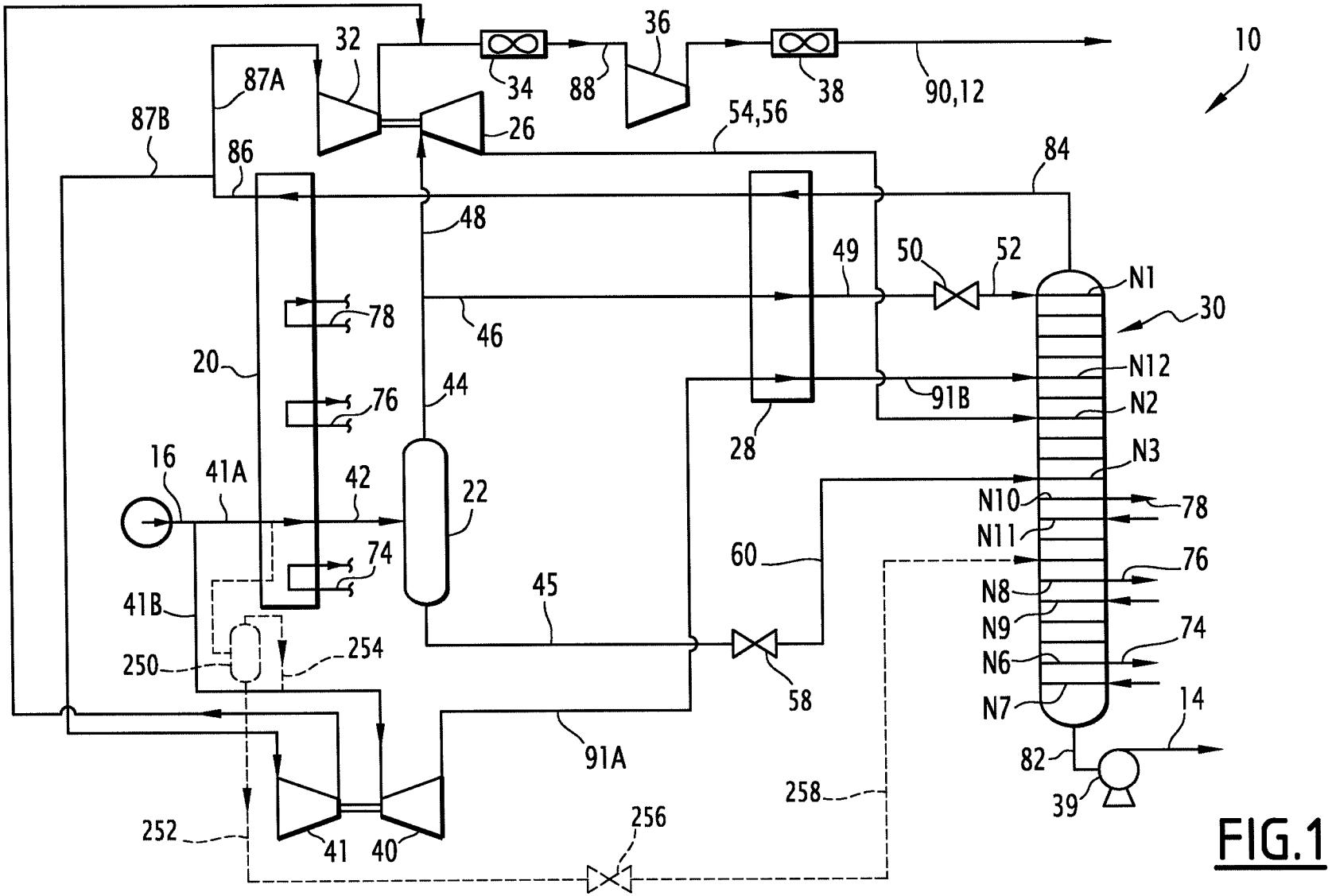
FIG. 1 is a summary flowchart of a first piece of production equipment intended to implement a first method according to the invention.

FIG. 1 illustrates a first piece of production equipment 10 for producing a methane-rich stream 12 and a $C_2^+$ hydrocarbon-rich fraction 14 according to the invention, from a feed gas stream 16.

The gas stream 16 is a natural gas stream, a refinery gas stream, or a synthetic gas stream obtained from a hydrocarbonaceous source such as coal, raw oil, or naphtha. In the example illustrated in the Figures, the stream 16 is a dehydrated natural gas stream.

The method and equipment 10 advantageously apply to the construction of a new methane and ethane recovery unit.

The equipment 10 comprises, from upstream to downstream, a first heat exchanger 20, a first separating flask 22, and a first dynamic expansion turbine 26, capable of producing work during the expansion of a stream passing through the turbine.

According to the invention, the equipment 10 also comprises a second heat exchanger 28, a first distillation column 30, a first compressor 32 coupled to the first dynamic expansion turbine 26, a first refrigerant 34, a second compressor 36, a second refrigerant 38, and a bottoms pump 39.

According to the invention, the equipment 10 also comprises a second dynamic expansion turbine 40 and a third compressor 41 coupled to the second dynamic expansion turbine 40.

A first production method according to the invention, implemented in the equipment 10, will now be described.

As an example, the feed stream 16 is made up of a dehydrated natural gas that comprises, in moles, 2.06% nitrogen, 83.97% methane, 6.31% ethane, 3.66% propane, 0.70% isobutane, 1.50% n-butane, 0.45% isopentane, 0.83% n-pentane, and 0.51% carbon dioxide.

The feed stream 16 more generally has, in moles, between 5 and 15% of $C_2^+$ hydrocarbons to be extracted and between 75 and 90% methane.

"Dehydrated gas" refers to a gas whereof the water content is as low as possible and is in particular lower than 1 ppm.

The feed stream 16 has a pressure greater than 35 bars, in particular greater than 50 bars and a temperature close to the ambient temperature, and in particular substantially equal to 30° C. The flow rate of the feed stream is in this example 15,000 kmoles/hour.

The feed stream 16 is first divided into a first feed stream fraction 41A and a second feed stream fraction 41B.

The ratio of the molar flow rate of the first fraction 41A to the second fraction 41B is for example greater than 2, and is in particular comprised between 2 and 15.

In the illustrated example, the first fraction 41A is injected into the first heat exchanger 20, where it is cooled and partially condensed to form a cooled feed stream fraction 42.

The temperature of the fraction 42 is below −10° C. and is in particular equal to −26.7° C. Then, the cooled fraction 42 is injected into the first separating flask 22.

The liquid content of the cooled fraction 42 is less than 50% molar.

A light gas head stream 44 and a heavy liquid bottoms stream 45 are extracted from the first separating flask 22.

In this example, the gas stream 44 is divided into a minority feed stream fraction 46 and a majority turbine feed fraction 48. The ratio of the molar flow rate of the majority fraction 48 to the minority fraction 46 is greater than 2.

The column feed fraction 46 is injected into the second heat exchanger 28 to be completely liquefied and sub-cooled therein. It forms a cooled column feed fraction 49. This fraction 49 is expanded in a first static expansion valve 50 to form an expanded fraction 52 injected in reflux into the first distillation column 30.

The temperature of the expanded fraction 52 obtained after passage in the valve 50 is less than −70° C., and is in particular equal to −111° C.

The pressure of the expanded fraction 52 is also substantially equal to the working pressure of the column 30, which is less than 40 bars and in particular comprised between 10 bars and 30 bars, advantageously equal to 17 bars.

The fraction 52 is injected into an upper part of the column 30 at a level N1, situated at the first stage starting from the top of the column 30.

The turbine feed fraction 48 is injected into the first dynamic expansion turbine 26. It undergoes a dynamic expansion up to a pressure P1 close to the working pressure of the column 30 to form a first expanded feed fraction 54 that has a temperature below −50° C., in particular equal to −79° C.

The expansion of the feed fraction 48 in the first turbine 26 makes it possible to recover 3574 kW of energy that cool the fraction 48.

The first expanded fraction 54, which is the effluent resulting from the first dynamic expansion turbine 26, makes up a first cooled reflux stream 56.

The liquid content of the cooled reflux stream 56 is greater than 5% molar.

The cooled reflux stream 56 is injected into a middle part of the column 30 situated under the upper part, at a level N2 lower than the level N1, and in this example corresponding to the sixth stage starting from the top of the column 30.

The liquid heavy stream 45 recovered at the bottom of the separating flask 22 is expanded in a second static expansion valve 58 to form an expanded heavy stream 60.

The pressure of the expanded heavy stream 60 is less than 50 bars, and is in particular substantially equal to the pressure of the column 30. The temperature of the expanded heavy stream 60 is less than −30° C., and is in particular substantially equal to −48° C.

The liquid heavy stream 45 is completely injected into the column 30 after its expansion in the valve 58, without passing through the first heat exchanger 20. In this way, the liquid heavy stream 45, before passing in the valve 58, and the expanded heavy stream 60 do not enter into a heat exchange relationship with the feed stream 16, or with the fractions 41A, 41B of said feed stream 16.

In particular, the heavy stream 45 does not pass into the heat exchanger 20 between the output of the separating flask 22 and the input of the column 30.

A first reboiling stream 74 is removed near the bottom of the column 30 at a temperature above −3° C., and in particular substantially equal to 9.6° C., at a level N6 situated below the level N3, advantageously at the twenty-first stage starting from the top of the column 30.

The first stream 74 is brought up to the first heat exchanger 20, where it is heated to a temperature above 3° C., and in particular equal to 16.3° C., before being sent back to a level N7 corresponding to the twenty-second stage starting from the top of the column 30.

A second reboiling stream 76 is removed at a level N8 situated above the level N6 and below the level N3, advantageously at the seventeenth stage starting from the top of the column. The second reboiling stream 76 is injected into the first heat exchanger 20 to be heated therein up to a temperature above −8° C., and in particular equal to −4.1° C. It is then returned to the column 30 at a level N9 situated below the level N8 and above the level N6, advantageously at the eighteenth stage starting from the top of the column 30.

A third reboiling stream 78 is removed a level N10 situated under the level N3 and above the level N8, advantageously at the thirteenth stage starting from the top of the column 30. The third reboiling stream 78 is then brought up to the first heat exchanger 20, where it is heated to a temperature above −30° C., and in particular equal to −19° C., before being returned to a level N11 of the column 30 situated under the level N10 and situated above the level N8, advantageously at the fourteenth stage starting from the top of the column 30.

In this way, the stream 52 is injected into the upper part of the column 30, which extends from a height greater than 35% of the height of the column 30, while the stream 60 is injected into a middle part that extends under the upper part.

The column 30 produces a liquid bottoms stream 82 at the bottom. The bottoms stream 82 has a temperature above 4° C., and in particular equal to 16.3° C.

In this way, the bottoms stream 82 contains, by moles, 1.17% carbon dioxide, 0.00% nitrogen, 0.43% methane, 42.89% ethane, 28.40% propane, 5.51% i-butane, 11.66% n-butane, 3.47% i-pentane, and 6.46% n-pentane.

More generally, the stream 82 has a ratio $C_1/C_2$ less than 3% molar, for example equal to 1%.

The stream 82 contains more than 80%, advantageously more than 87% by moles of the ethane contained in the feed stream 16, and it contains substantially 100% by moles of the $C_3^+$ hydrocarbons contained in the feed stream 16.

The bottoms stream 82 is pumped into the pump 39 to form the $C_2^+$ hydrocarbon-rich fraction 14.

It can advantageously be heated by putting it in a heat exchange relationship with at least one fraction of the feed stream 16 up to a temperature below its boiling temperature, to keep it in liquid form.

The column 30 produces, at the head thereof, a methane-rich overhead gas stream 84. The stream 84 has a temperature below −70° C., and in particular substantially equal to −105° C. It has a pressure substantially equal to the pressure of the column 30, for example equal to 17.0 bars.

The head stream 84 is successively injected into the second heat exchanger 28, then into the first heat exchanger 20 to be heated therein and form a heated methane-rich head stream 86. The stream 86 has a temperature above −10° C., and in particular equal to 22.9° C.

At the output of the first exchanger 20, the stream 86 is divided into a first fraction of the heated head stream 87A and a second fraction of the heated head stream 87B.

The ratio of the molar flow rate of the first fraction 87A to the molar flow rate of the second fraction 87B is greater than 2, and is in particular for example comprised between 2 and 5.

The first fraction 87A is injected into the first compressor 32 driven by the main turbine 26 to be compressed therein by pressure above 20 bars.

The second fraction 87B is injected into the third compressor 41 to be compressed at a pressure greater than 20 bars and substantially equal to the pressure at which the first fraction 87A is compressed in the first compressor 32.

Then, the compressed fractions 87A, 87B respectively resulting from the compressors 32, 41 are brought together before being injected into the first air refrigerant 34. The reunited fractions 87A, 87B are cooled therein to a temperature below 60° C., in particular to the ambient temperature.

The compressed stream 88 thus obtained is injected into the second compressor 36, then into the second refrigerant 38 to form a compressed head stream 90.

The stream 90 thus has a pressure greater than 40 bars, and in particular substantially equal to 63.1 bars.

The compressed overhead stream 90 forms the methane-rich stream 12 produced by the method according to the invention.

Its composition is advantageously 96.28% molar of methane, 2.37% molar of nitrogen, and 0.92% molar of ethane. It comprises more than 99.93% of the methane contained in the feed stream 16 and less than 5% of the $C_2^+$ hydrocarbons contained in the feed stream 16.

The second fraction 41B of the feed stream 16 is injected into the second dynamic expansion turbine 40 to be expanded at a second pressure P2 substantially equal to the pressure of the column 30 and to thereby form a second expanded feed fraction 91A.

The temperature of the second fraction 41B feeding the second dynamic expansion turbine 40 is higher than the temperature of the turbine feed fraction 48 feeding the first dynamic expansion turbine 26, for example by at least 30° C.

Furthermore, the second pressure P2 is substantially equal to the first pressure P1. The difference between the pressure P1 and the pressure P2 is in particular less than 8 bars, advantageously less than 5 bars, and in particular less than 2 bars.

The second expanded fraction 91A thus has a temperature below 0° C., and in particular in the vicinity of −25° C.

Then, the second fraction 91A is injected into the second heat exchanger 28 to be cooled therein to a temperature below −70° C., and in particular equal to −102.5° C., and to be partially condensed therein, by heat exchange with the head stream 84 and possibly with the column feed fraction 46, when it is present.

The second expanded fraction 91B from the second heat exchanger 28 forms a second reflux stream that is conveyed to the column 30 to be injected therein into the upper part of the level N12 for example situated between the level N1 and the level N2, at the fourth stage starting from the top of the column.

Examples of temperatures, pressures, and molar flow rates of the different streams are provided in Table 1 below.

TABLE 1

| Stream | Temperature (° C.) | Pressure (bara) | Flow rate (kmol/h) |
|---|---|---|---|
| 12, 90 | 40.0 | 63.1 | 13074 |
| 82 | 16.3 | 17.2 | 1926 |
| 16 | 30.0 | 62.0 | 15000 |
| 41A | 30.0 | 62.0 | 12500 |
| 41B | 30.0 | 62.0 | 2500 |
| 42 | −26.7 | 61.0 | 12500 |
| 44 | −26.7 | 61.0 | 11195 |
| 45 | −26.7 | 61.0 | 1305 |
| 46 | −26.7 | 61.0 | 2460 |

TABLE 1-continued

| Stream | Temperature (° C.) | Pressure (bara) | Flow rate (kmol/h) |
|---|---|---|---|
| 48 | −26.7 | 61.0 | 8735 |
| 49 | −102.8 | 60.0 | 2460 |
| 52 | −111.2 | 17.2 | 2460 |
| 54. 56 | −78.6 | 17.2 | 8735 |
| 60 | −48.2 | 17.2 | 1305 |
| 84 | −104.8 | 17.0 | 13074 |
| 86 | 22.9 | 16.0 | 13074 |
| 87A | 22.9 | 16.0 | 9387 |
| 87B | 22.9 | 16.0 | 3687 |
| 88 | 40.0 | 24.3 | 13074 |
| 91A | −25.5 | 18.2 | 2500 |
| 91B | −102.5 | 17.2 | 2500 |

Table 2 below illustrates the power consumed by the compressor 36 as a function of the flow rate of the second fraction 41B sent toward the second turbine 40.

TABLE 2

| Ethane recovery (% moles) | Flow rate toward turbine 40 (kmol/h) | Turbine 26 power (kW) | Turbine 40 power (kW) | Compressor 36 power (kW) |
|---|---|---|---|---|
| 87.20 | 0 | 4381 | 0 | 14111 |
| 87.20 | 1600 | 3974 | 923 | 12996 |
| 87.20 | 2500 | 3574 | 1405 | 12244 |

The energy consumption of the method according to the invention, made up of the driving energy of the second compressor 36, is 12244 kW, versus 14111 kW with the method from the state of the art according to U.S. Pat. Nos. 4,157,904 or 4,278,457, in which the same flow rate for the load to be treated is used and the same recovery achieved.

Relative to the state of the art, the method according to the invention therefore makes it possible to obtain a significant reduction in the consumed power, while preserving high selectivity for the ethane extraction.

Figure 2:
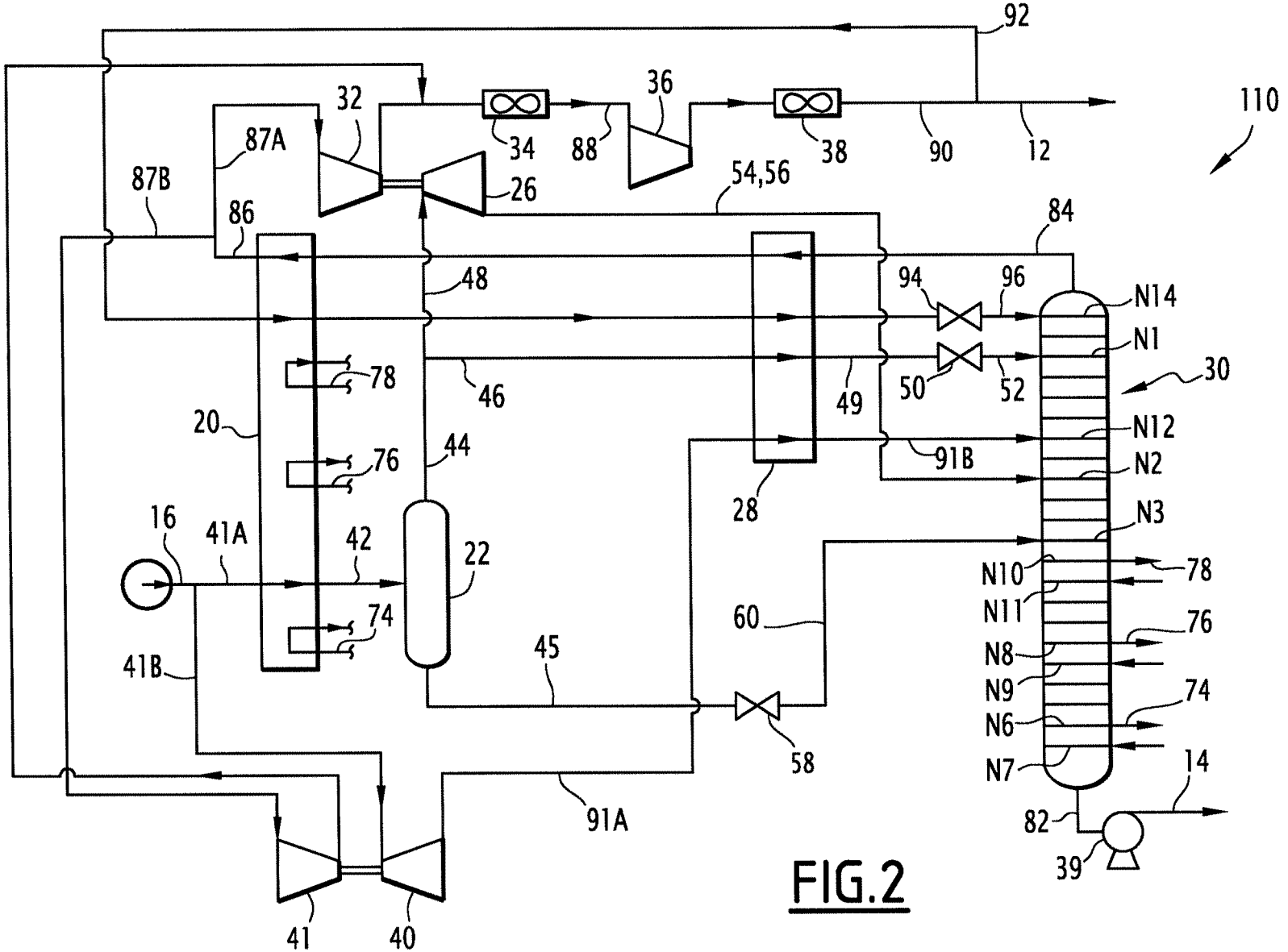
FIG. 2 is a summary flowchart of a second piece of production equipment intended to implement a second method according to the invention.

A second piece of equipment 110 according to the invention is shown in FIG. 2. This piece of equipment 110 is intended to implement a second method according to the invention.

The second method differs from the first method in that a bleed stream 92 is removed from the compressed head stream 90.

The bleed stream 92 has a non-zero molar flow rate comprised between 0% and 35% of the molar flow rate of the compressed head stream 90 upstream of the removal, the rest of the compressed head stream 90 forming the stream 12.

The bleed stream 92 is successively cooled in the first exchanger 20, then in the second exchanger 28, before being expanded in a third static expansion valve 94.

The stream 96, which, before expansion in the valve 94, is essentially liquid, has a liquid fraction greater than 0.8 after expansion.

The expanded bleed stream 96 from the third valve 94 is then injected in reflux near the head of the column 30 at a level N14 situated above the level N1 and advantageously corresponding to the first stage of the column 30.

The temperature of the expanded bleed stream 96 before its injection into the column 30 is less than −70° C., and is advantageously equal to −113.5° C.

Examples of temperatures, pressures, and molar flow rates of the different streams are provided in Table 3 below.

TABLE 3

| Stream | Temperature (° C.) | Pressure (bara) | Flow rate (kmol/h) |
|---|---|---|---|
| 12 | 40.0 | 63.1 | 12962 |
| 82 | 15.5 | 17.7 | 2038 |
| 16 | 30.0 | 62.0 | 15000 |
| 41A | 30.0 | 62.0 | 13000 |
| 41B | 30.0 | 62.0 | 2000 |
| 42 | −26.0 | 61.0 | 13000 |
| 44 | −26.0 | 61.0 | 11676 |
| 45 | −26.0 | 61.0 | 1324 |
| 46 | −26.0 | 61.0 | 1865 |
| 48 | −26.0 | 61.0 | 9811 |
| 49 | −108.7 | 60.0 | 1865 |
| 52 | −111.2 | 17.7 | 1865 |
| 54, 56 | −76.9 | 17.7 | 9811 |
| 60 | −46.9 | 17.7 | 1324 |
| 84 | −110.7 | 17.5 | 14786 |
| 86 | 25.1 | 16.5 | 14786 |
| 87A | 25.1 | 16.5 | 11566 |
| 87B | 25.1 | 16.5 | 3220 |
| 88 | 40.0 | 24.0 | 14786 |
| 90 | 40.0 | 63.1 | 14786 |
| 91A | −24.4 | 18.7 | 2000 |
| 91B | −105.0 | 17.7 | 2000 |
| 92 | 40.0 | 63.1 | 1824 |
| 96 | −113.5 | 17.7 | 1824 |

In one alternative (not shown), the second compressor 36 can comprise two compression stages separated by an aero-refrigerant.

The power consumed by the compressor 36 (single stage) as a function of the flow rate of the second feed stream fraction 41B is provided in table 4 below.

TABLE 4

| Ethane recovery % mole | Flow rate toward the turbine 40 kmol/h | Turbine 26 power kW | Turbine 40 power kW | Compressor 36 power kW |
|---|---|---|---|---|
| 99.00 | 0 | 4421 | 0 | 15416 |
| 99.00 | 1000 | 4235 | 546 | 14510 |
| 99.00 | 1700 | 4051 | 928 | 14202 |
| 99.00 | 2000 | 3951 | 1100 | 14105 |
| 99.00 | 2500 | 3738 | 1415 | 14121 |

The second method according to the invention therefore makes it possible to obtain extremely high ethane recovery rates, greater than 90%, and in particular greater than 99%. This quasi-total recovery of the ethane contained in the feed stream 16 can be obtained as in the method described in the U.S. Pat. No. 5,568,737, but with savings in terms of consumed power that can be greater than 8%, in the vicinity of 1300 kW.

Figure 3:
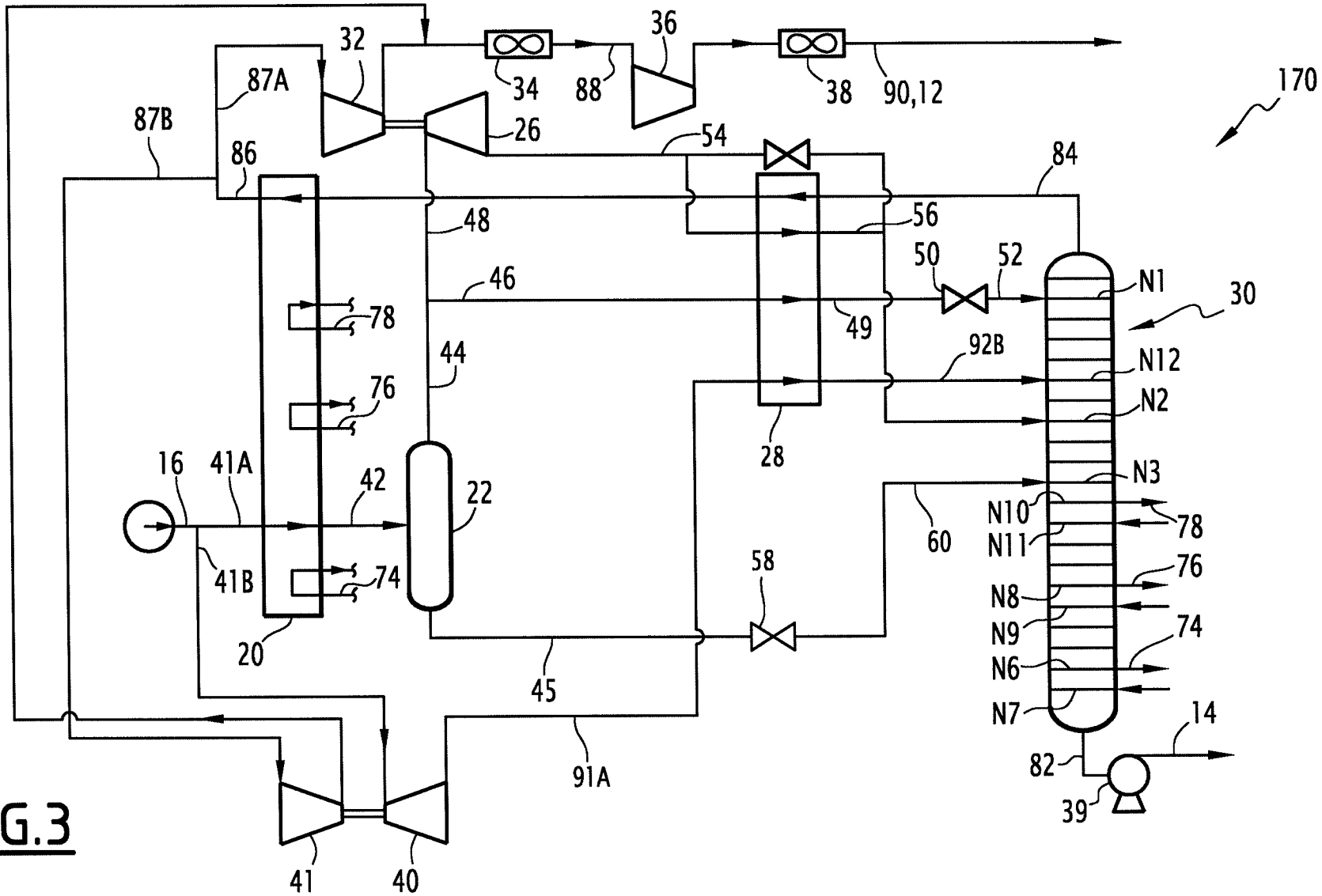
FIG. 3 is a summary flowchart of a third piece of production equipment intended to implement a fifth method according to the invention.

A third piece of equipment 170 according to the invention is shown in FIG. 3.

The third piece of equipment 170 is intended to implement a third method according to the invention.

The third method according to the invention differs from the first method according to the invention in that the expanded feed fraction 54 intended for the column 30 is at least partially injected in the second heat exchanger 28 to be put in a heat exchange relationship therein with the methane-rich overhead gas stream 84, with the second expanded feed fraction 91A from the second dynamic expansion turbine 40, and advantageously with the column feed fraction 46, when the latter is present.

The fraction 54 is thus cooled to a temperature below −60° C., and in particular substantially equal to −84° C. It is at least partially condensed to form the first cooled reflux stream 56.

The cooled reflux stream 56 is then injected into the middle part of the column 30 at the level N2, as described above.

A bypass may be provided to inject part of the expanded fraction 54 into the column 30 without going through the exchanger 28.

Examples of temperatures, pressures, and molar flow rates of the different streams are provided in Table 5 below.

TABLE 5

| Stream | Temperature (° C.) | Pressure (bara) | Flow rate (kmol/h) |
|---|---|---|---|
| 12, 90 | 40.0 | 63.1 | 13071 |
| 82 | 17.4 | 17.7 | 1929 |
| 16 | 30.0 | 62.0 | 15000 |
| 41A | 30.0 | 62.0 | 13340 |
| 41B | 30.0 | 62.0 | 1560 |
| 42 | −26.5 | 61.0 | 13440 |
| 44 | −26.5 | 61.0 | 12049 |
| 45 | −26.5 | 61.0 | 1391 |
| 46 | −26.5 | 61.0 | 2328 |
| 48 | −26.5 | 61.0 | 9721 |
| 49 | −102.2 | 60.0 | 2328 |
| 52 | −110.5 | 17.7 | 2328 |
| 54 | −77.5 | 17.7 | 9721 |
| 56 | −84.4 | 17.6 | 9721 |
| 60 | −47.5 | 17.7 | 1391 |
| 84 | −104.2 | 17.5 | 13071 |
| 86 | 24.3 | 16.5 | 13071 |
| 87A | 24.3 | 16.5 | 10714 |
| 87B | 24.3 | 16.5 | 2358 |
| 88 | 40.0 | 24.6 | 13071 |
| 91A | −24.5 | 18.7 | 1560 |
| 91B | −102.2 | 17.7 | 1560 |

Figure 4:
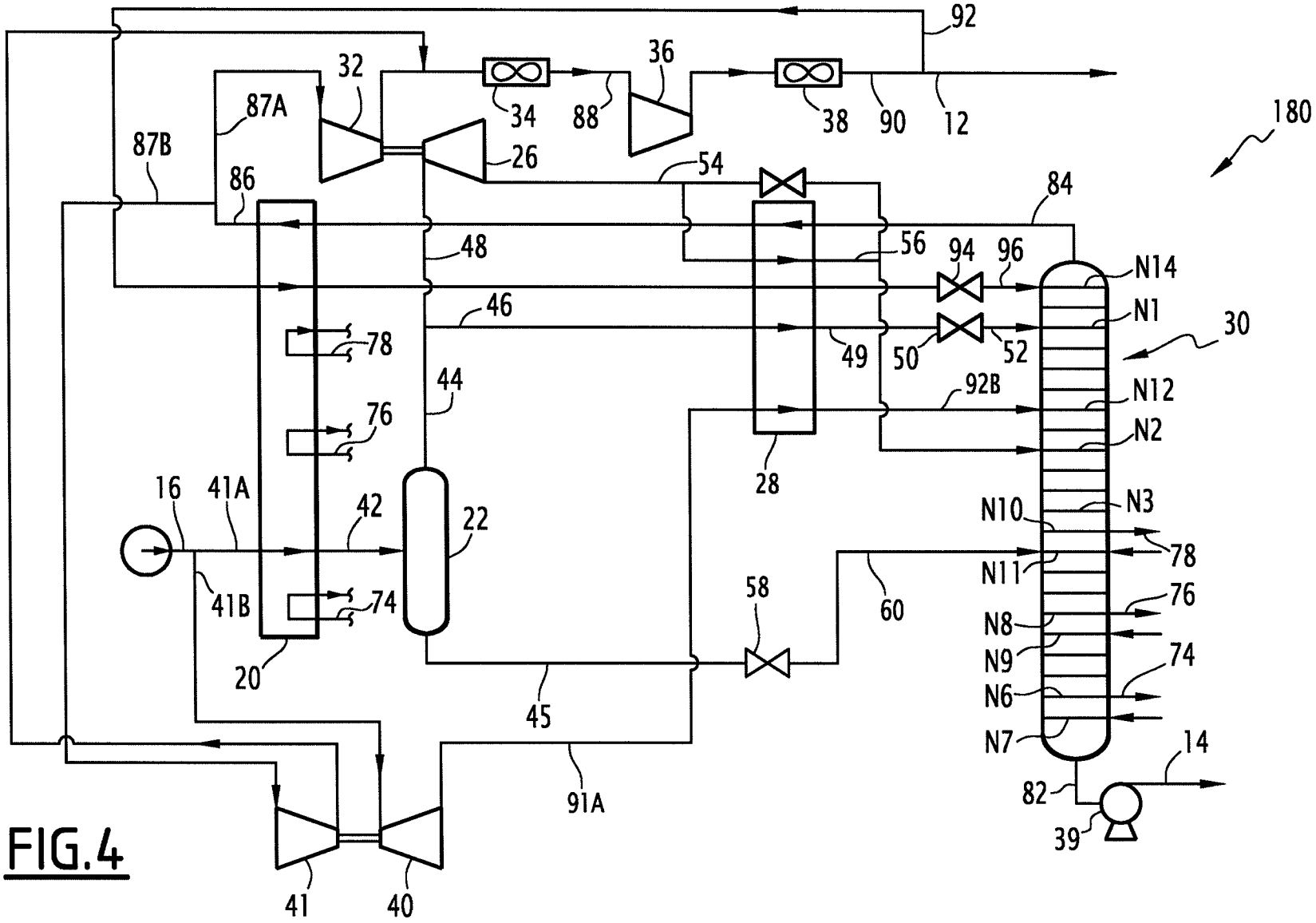
FIG. 4 is a summary flowchart of a fourth piece of production equipment intended to implement a sixth method according to the invention.

A fourth piece of equipment 180 according to the invention is shown in FIG. 4. The fourth piece of equipment 180 is intended to implement a fourth method according to the invention.

The fourth method according to the invention differs from the third method according to the invention, shown FIG. 3, in that a bleed stream 92 is removed from the compressed head stream 90, then is successively passed through the first heat exchanger 20, then the second heat exchanger 28, as described in the second method according to the invention.

The fourth method according to the invention is also similar to the third method according to the invention.

Figure 5:
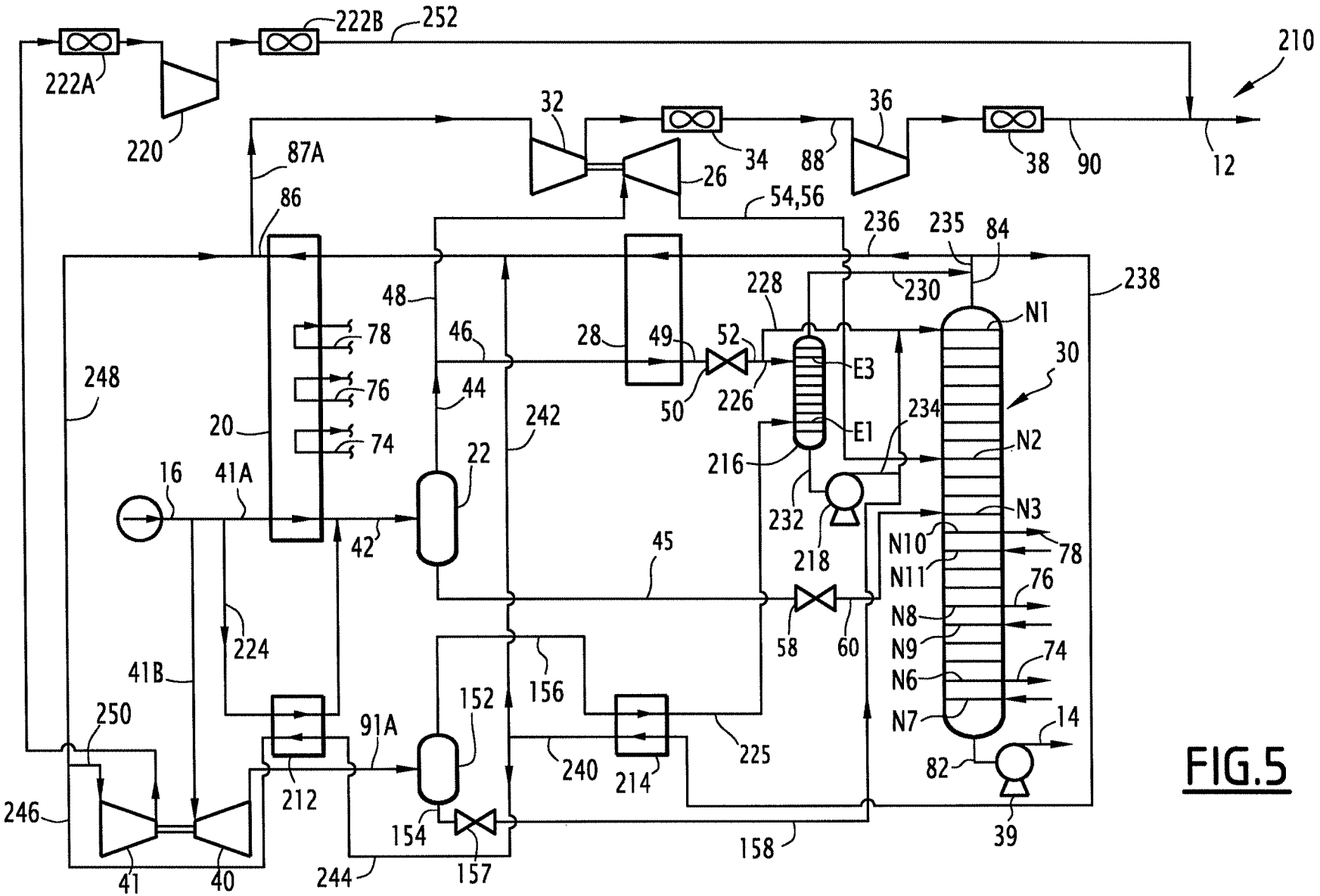
FIG. 5 is a summary flowchart of a fifth piece of production equipment intended to implement a seventh method according to the invention.

A fifth piece of equipment 210 according to the invention is shown in FIG. 5. This fifth piece of equipment 210 is intended to implement a fifth method according to the invention.

The fifth piece of equipment 210 is advantageously intended to increase $C_2^+$ recovery in an existing piece of equipment, in particular of the type described in patents U.S. Pat. Nos. 4,157,904; 4,278,457.

The existing equipment comprises the first heat exchanger 20, the first separating flask 22, the distillation column 30, the first compressor 32 coupled to the first expansion turbine 26, and the second compressor 36.

The fifth piece of equipment 210 according to the invention also comprises a second dynamic expansion turbine 40, a third compressor 41, and a downstream separating flask 152 to collect the effluent from the second dynamic expansion turbine 40.

The equipment 210 also comprises an upstream heat exchanger 212, a downstream heat exchanger 214, and an auxiliary distillation column 216 provided with an auxiliary bottoms pump 218.

The fifth piece of equipment 210 also comprises a fourth compressor 220 inserted between two aero-refrigerants 222A, 222B.

The fifth piece of equipment 210 also comprises a downstream separating flask 152, arranged downstream of the second turbine 40.

The fifth method according to the invention differs from the first method according to the invention in that the feed current 16 is also separated into a third fraction 224 of the feed current that is injected into the upstream heat exchanger 212, before being mixed with the first fraction 41A from the exchanger 20 to form the first cooled fraction 42.

The ratio of the molar flow rate of the third fraction 224 to the molar flow rate of the feed stream 16 is greater than 5%.

In this way, the fifth method according to the invention differs from the first method according to the invention in that the second feed fraction 91A, cooled and partially liquefied, is injected into the downstream separating flask 152.

This fraction 91A is separated in the downstream separating flask 152 into a second liquid bottoms stream 154 and a second gas head stream 156.

The second liquid bottoms stream 154 is injected into a fourth static expansion valve 157 to be expanded there substantially at the pressure of the column 30 and to form a second expanded bottoms stream 158.

Unlike the first method according to the invention described above, the second head stream 156 from the downstream separating flask 152 is injected into the downstream heat exchanger 214 to be cooled therein to a temperature below −70° C. and form a second cooled head stream 225.

The second cooled head stream 225 is injected into the auxiliary column 216 at a lower stage E1.

The column 216 has a theoretical number of stages lower than the theoretical number of stages of the column 30. This number of stages is advantageously comprised between 1 and 7. The auxiliary column 216 operates at a pressure substantially equal to that of the column 30.

The expanded bottoms stream 158 obtained after expansion of the second bottoms stream 154 in the valve 157 is injected into the column 30 a level N1 advantageously corresponding to the first stage from the top of the column 30.

A first part 226 of the fraction 52 expanded in the valve 50 is injected into the auxiliary column 216 at a stage E3 situated above the level E1. A second part 228 of the fraction 52 is injected directly into the column 30 at the level N1, after mixing with the stream 158.

The auxiliary column 216 produces a methane-rich auxiliary head stream 230 and an auxiliary bottoms stream 232.

The auxiliary head stream 230 is mixed with the methane-rich head stream 84 produced by the distillation column 30.

The bottoms stream 232 is pumped by the auxiliary pump 218 to form a cooled reflux stream 234 that is injected into the column 30 after mixing with the stream 158.

The stream 234 therefore constitutes a cooled reflux stream that is obtained from a part of the expanded fraction 91A from the second dynamic expansion turbine 40, after separation of that effluent.

The mixture 235 of the head streams 84 and 230 is separated into a first majority head stream fraction 236 and the second minority head stream fraction 238.

The ratio of the molar flow rate of the majority fraction 236 to the minority fraction 238 is greater than 1.5.

The majority fraction 236 is successively injected into the second heat exchanger 28, then into the first heat exchanger 20, so as to form the heated head stream 86.

The second head stream fraction 238 is passed into the downstream heat exchanger 214 countercurrent to the second head stream 156 to be heated there to a temperature above −50° C. and form a second heated fraction 240.

The second heated fraction 240 is then separated into a return stream 242 and decompression stream 244.

The return stream 242 is reinjected into the first head stream fraction 236, downstream of the second exchanger 28 and upstream of the first exchanger 20 to partially form the heated head stream 86.

The recompression stream 244 is then injected into the upstream exchanger 212 to cool the third fraction of the feed stream 224. The stream 244 heats up to a temperature above −10° C. to form a heated recompression stream 246.

A first part 248 of the recompression stream 246 is mixed with the first fraction of the head stream 86, downstream of the first heat exchanger 20 to form the heated head stream 87A.

A second part 250 of the recompression stream 246 is injected into the third compressor 41, then the aero-refrigerant 222A, before being recompressed in the fourth compressor 220 and injected into the aero-refrigerant 222B.

The second compressed part 252 from the aero-refrigerant 222B has a temperature below 60° C., and in particular substantially equal to 40° C., and a pressure greater than 35 bars, and in particular equal to 63.1 bars.

This first compressed part 252 is mixed with the compressed head stream 90 to form the methane-rich stream 12.

The fifth piece of equipment 210 and the fifth method according to the invention therefore make it possible to increase the $C_2^+$ hydrocarbon recovery rate in an existing piece of equipment of the state of the art, without having to modify the existing pieces of the equipment, and in particular while keeping the heat exchangers 20 and 28, the column 30, the compressors 32, 36 and the turbine 26 identical, and using the input already present on the column 30.

To keep the existing equipment intact and improve the $C_2^+$ recovery, the pressure of the column 30 has been slightly decreased. Without countermeasure, this decrease would have caused an increase in the power of the compressor 36.

However, the addition of the compressor 220 makes it possible to offset this problem. Furthermore, the flow rate through the existing turbine 26 and its power have not been increased relative to the existing unit.

This piece of equipment nevertheless makes it possible to obtain, with an excellent output, a much greater ethane recovery than that observed in the state of the art.

Figure 6:
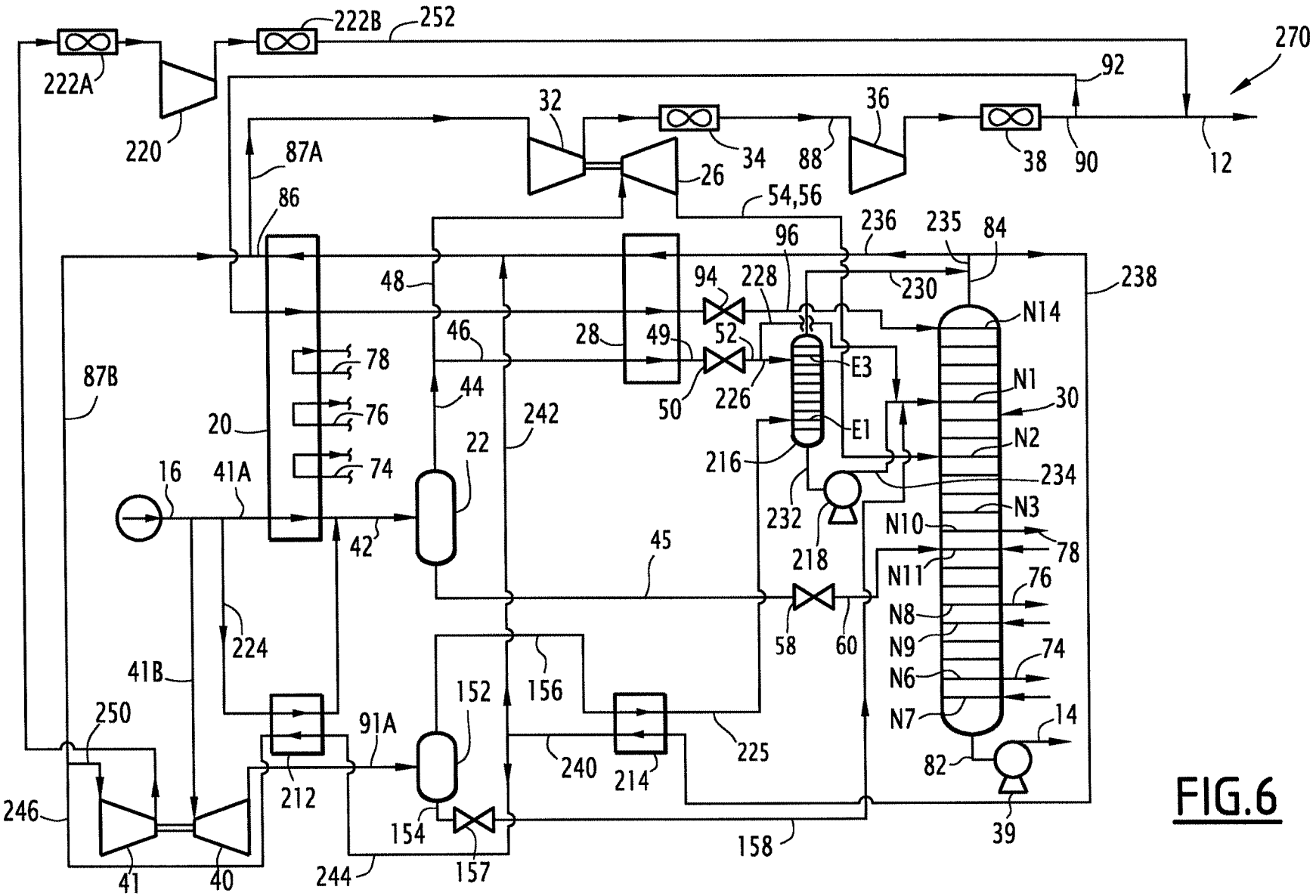
FIG. 6 is a summary flowchart of a sixth piece of production equipment intended to implement an eighth method according to the invention.

A sixth piece of equipment 270 according to the invention is shown in FIG. 6. This sixth piece of equipment 270 is intended to implement a sixth method according to the invention.

The sixth method according to the invention differs from the fifth method according to the invention in that a bleed stream 92 is removed from the compressed methane-rich head stream 90, advantageously upstream of the injection point of the second compressed part 252 in the stream 90.

The bleed stream 92 is reinjected into the column 30 at a head level N14. Unlike the fifth method according to the invention, the second part 228 of the fraction 52 and the expanded bottoms stream 158 are injected into the column at a level N5 situated under the head level N14 and above the level N2.

The implementation of the sixth method according to the invention is also similar to that of the fifth method according to the invention.

To keep the $C_2^+$ recovery of the existing unit, the pressure of the column 30 is slightly decreased. The presence of the new compressor 220 makes it possible to keep the power of the second compressor 36 identically, despite the increased flow rate of the feed stream 16.

Furthermore, the capacity of the first dynamic expansion turbine 26 has been kept constant. The second dynamic expansion turbine 40 is used to handle the added capacity.

The presence of an auxiliary column 216 also makes it possible to avoid flooding of the column 30 during the flow rate increase.

The sixth piece of equipment according to the invention makes it possible to preserve an ethane recovery greater than or equal to 99%, a temperature and pressure of the feed stream 16 that are substantially identical. Likewise, the pressure losses allocated in the equipment, the efficiencies of the plates in the column 30 and the position of the bleeds, the maximum methane specification of the bottoms stream 82 of the column 30, the efficiencies of the turbines and compressors, the power of the second compressor 36 and the existing turbine 26, and the heat exchange coefficients of the existing exchangers 20 and 28 are kept identical.

In one alternative (shown in broken lines in FIG. 1), which can apply to each of the embodiments of FIGS. 1 to 6, the second fraction 41B of the feed stream is removed in the first exchanger 20 and not upstream of the latter. The second fraction 41B is therefore partially cooled and is partially liquefied in the first heat exchanger 20.

The second fraction 41B from the first heat exchanger 20 is then possibly injected into an upstream separating flask 250. It is then separated in the upstream separating flask 250 into a second bottoms liquid fraction 252 and a second gas head fraction 254. The second bottoms fraction 252 is expanded in a static expansion valve 256 to a pressure below 40 bars and substantially equal to the pressure of the column 30.

The second expanded bottoms fraction 258 is then injected into the column 30, advantageously between the level N11 and the level N8.

The second head fraction 254 is injected into the second dynamic expansion turbine 40 to form the second expanded feed fraction 91A.

This arrangement with an upstream separating flask also applies to the case where the feed stream 16 contains a liquid fraction.

In another alternative (not shown) of the embodiments of FIGS. 2, 4 and 6, the equipment comprises a bypass valve for part of the bleed stream 92 to divert that part upstream of the first dynamic expansion turbine 26.

In this alternative method, an extra cooling stream is removed from the bleed stream obtained after its passage in the first heat exchanger 20. The extra cooling stream is reinjected upstream of the turbine 26, either in the head stream 44, or upstream of the separating flask 22 in the cooled feed stream 42.

In another alternative (not shown) of the embodiments of FIGS. 1 to 8, the equipment comprises a plurality of first exchangers 28, each being intended to receive a fraction of the head stream 84 and another stream.

The head stream 84 is then divided into a plurality of fractions corresponding to the number of second exchangers 28.

Each second exchanger 28 can then put into a heat exchange only two flows each including a fraction of the head stream 84 and, respectively, the first expanded feed fraction 54, the second expanded feed fraction 91A, and, if applicable, the column feed fraction 46 and/or the removal fraction 92.

In another alternative (not shown) of the embodiments of FIGS. 1 to 6, a reboiling stream is removed from the distillation column at a removal level. The reboiling stream is then put into a heat exchange relationship with at least one part of the second expanded fraction 91A from the dynamic expansion turbine 40, and potentially with the first expanded fraction 54 of the first turbine 26.

This placement in a heat exchange relationship can be done within the second heat exchanger 28.

In still another alternative (not shown), an auxiliary expansion stream is removed from the methane-rich overhead stream 86 from the first heat exchanger 20. This auxiliary expansion stream is injected into an auxiliary dynamic expansion turbine, separate from the first dynamic expansion turbine 26 and the second dynamic expansion turbine 40. The expanded stream from the auxiliary turbine is reinjected into the methane-rich overhead stream, before its passage in the first heat exchanger 20, to form an extra cooling stream of the first heat exchanger 20.

More generally, the entire head stream 44 from the first separating flask 22 can form the turbine feed fraction 48. The method according to the invention is then provided with no separation of the head stream 44.

The invention claimed is:

1. A method for producing a methane-rich stream and a $C2^+$ hydrocarbon-rich stream from a feed stream containing hydrocarbons, said method comprising the following steps:

separating the feed stream into a first fraction of the feed stream and at least one second fraction of the feed stream;

cooling the first fraction of the feed stream in a first heat exchanger to produce a cooled first fraction, said separating of the feed stream occurs upstream of the cooling of the first fraction of the feed stream;

injecting the cooled first fraction of the feed stream in a first separating flask to produce a light head stream and a heavy bottoms stream;

expanding a turbine feed fraction formed from the light head stream in a first dynamic expansion turbine to a first pressure and injecting at least part of the first expanded fraction coming from the first turbine into a first distillation column;

expanding the whole heavy bottoms stream to form an expanded bottoms stream and injecting the expanded bottoms stream into the first distillation column without going through the first heat exchanger between the first separating flask and the first distillation column;

recovering a bottoms stream at the bottom of the first distillation column, the $C2^+$ hydrocarbon-rich stream being formed from the bottoms stream;

recovering and heating a methane-rich overhead stream from the first distillation column;

compressing at least one fraction of the methane-rich overhead stream in at least a first compressor coupled to the first dynamic expansion turbine and in at least one second compressor;

injecting an entirety of the of the second fraction of the feed stream into a second dynamic expansion turbine, separate from the first dynamic expansion turbine, without cooling between the step for separating the feed stream and the step of injecting the second fraction of the feed stream into the second dynamic expansion turbine;

expanding the entirety of the second fraction of the feed stream in the second dynamic expansion turbine to a second pressure, to form a second expanded fraction coming from the second dynamic expansion turbine, the second pressure being substantially equal to the first pressure; and cooling and at least partially liquefying at least part of the second expanded fraction coming from the second dynamic expansion turbine to form a cooled reflux stream, and injecting the cooled reflux stream into the first distillation column, wherein no stream issuing from the second dynamic expansion turbine enters into heat exchange in a heat exchanger with the first fraction of the feed stream, upstream of the distillation column.

2. The method according to claim 1, wherein said method includes injecting the first expanded fraction from the first dynamic expansion turbine into a second heat exchanger to be cooled and partially liquefied therein, the first cooled expanded fraction forming an additional cooled reflux stream, the method including the injection of the additional cooled reflux stream into the first distillation column.

3. The method according to claim 1, wherein said method further comprises the following steps: removing a secondary compression fraction in the methane-rich overhead stream, before the passage of a fraction of the methane-rich overhead stream in the first compressor, passage of the secondary fraction in a third compressor coupled to the second dynamic expansion turbine; injecting the compressed secondary fraction from the third compressor into the fraction of the compressed overhead stream, downstream of the first compressor.

4. The method according to claim 1, wherein at least part of the second expanded fraction from the second dynamic expansion turbine, at least one fraction of the overhead stream, and possibly the first expanded fraction from the first dynamic expansion turbine, are placed in a heat exchange relationship.

5. The method according to claim 1, wherein said method further comprises the following steps: dividing the light head stream into the turbine feed fraction and a column feed fraction; cooling and at least partially condensing the column feed fraction in a second heat exchanger to form a cooled feed fraction; expanding and at least partially injecting the cooled column feed fraction into the first distillation column; and at least part of the second expanded fraction from the second dynamic expansion turbine and the column feed fraction advantageously being placed in a heat exchange relationship.

6. The method according to claim 1, wherein said method further comprises the following steps: removing a bleed stream from the overhead stream; cooling the bleed stream at least in the first heat exchanger and injecting the cooled bleed stream into the first distillation column; and optionally, heat exchange of the bleed stream with at least part of the second expanded fraction from the second turbine.

7. The method according to claim 1, wherein the heavy bottoms stream issuing from the first separating flask is expanded in an expansion valve to form the expanded bottoms stream, the expanded bottoms stream being injected in the first distillation column without passing through the first heat exchanger between the outlet of the expansion valve and the injection into the first distillation column.

* * * * *